US011605360B2

(12) United States Patent
Yang et al.

(10) Patent No.: US 11,605,360 B2
(45) Date of Patent: Mar. 14, 2023

(54) CIRCUIT AND METHOD FOR PREVENTING SCREEN FLICKERING, DRIVE CIRCUIT FOR DISPLAY PANEL, AND DISPLAY APPARATUS

(71) Applicants: HEFEI BOE DISPLAY TECHNOLOGY CO., LTD., Anhui (CN); BOE TECHNOLOGY GROUP CO., LTD., Beijing (CN)

(72) Inventors: Xiuqin Yang, Beijing (CN); Rongcheng Liu, Beijing (CN); Peng Zhao, Beijing (CN); Huiming Wang, Beijing (CN); Jing Ma, Beijing (CN); Siying Lu, Beijing (CN); Chao Kong, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 158 days.

(21) Appl. No.: 17/259,218

(22) PCT Filed: Jun. 22, 2020

(86) PCT No.: PCT/CN2020/097522
§ 371 (c)(1),
(2) Date: Jan. 11, 2021

(87) PCT Pub. No.: WO2020/259450
PCT Pub. Date: Dec. 30, 2020

(65) Prior Publication Data

US 2021/0256927 A1 Aug. 19, 2021

(30) Foreign Application Priority Data

Jun. 26, 2019 (CN) ..... 201910561102.3

(51) Int. Cl.
*G09G 3/00* (2006.01)
*G09G 3/36* (2006.01)

(52) U.S. Cl.
CPC ... *G09G 3/3677* (2013.01); *G09G 2300/0408* (2013.01); *G09G 2310/0289* (2013.01);
(Continued)

(58) Field of Classification Search
None
See application file for complete search history.

(56) References Cited

U.S. PATENT DOCUMENTS 7,791,582 B2 9/2010 Chang et al.
2006/0007095 A1 1/2006 Kudo et al.
(Continued)

FOREIGN PATENT DOCUMENTS

CN 101620828 A 1/2010
CN 101996549 A 3/2011
(Continued)

OTHER PUBLICATIONS

First office action of Chinese application No. 201910561102.3 dated Dec. 25, 2020.

*Primary Examiner* — Michael A Faragalla
(74) *Attorney, Agent, or Firm* — Lippes Mathias LLP

(57) ABSTRACT

Circuit and method for preventing screen flickering, a drive circuit for a display panel, and a display apparatus are provided, relating to the field of display technology. The circuit for preventing screen flickering includes a control sub-circuit configured to control a gate drive circuit of the display panel to output a gate cut-off level during a power-on period of the display panel. The gate drive circuit of the display panel is controlled to output the gate cut-off level during the power-on period, the gate cut-off level is provided to gate lines of the display panel such that TFTs connected
(Continued)

to the gate lines are in cut-off state during the power-on period.

18 Claims, 5 Drawing Sheets

(52) U.S. Cl.
CPC . *G09G 2310/08* (2013.01); *G09G 2320/0247* (2013.01); *G09G 2330/026* (2013.01); *G09G 2330/08* (2013.01)

(56) References Cited

U.S. PATENT DOCUMENTS

| | | | | |
|---|---|---|---|---|
| 2012/0147291 | A1 | 6/2012 | Seo | |
| 2014/0085172 | A1 | 3/2014 | Wu et al. | |
| 2017/0345372 | A1 | 11/2017 | Xiao et al. | |
| 2018/0137831 | A1 | 5/2018 | Murakami et al. | |
| 2018/0247596 | A1* | 8/2018 | Zhao | G09G 3/3233 |
| 2019/0005887 | A1* | 1/2019 | Tanikame | G09G 3/3291 |
| 2019/0251928 | A1* | 8/2019 | Du | G09G 3/20 |

FOREIGN PATENT DOCUMENTS

| | | | |
|---|---|---|---|
| CN | 104795038 | A | 7/2015 |
| CN | 105118472 | A | 12/2015 |
| CN | 105702211 | A | 6/2016 |
| CN | 106097963 | A | 11/2016 |
| CN | 109410861 | A | 3/2019 |
| CN | 109637494 | A | 4/2019 |
| CN | 109785787 | A | 5/2019 |
| CN | 109872699 | A | 6/2019 |
| CN | 110264971 | A | 9/2019 |
| KR | 20190032959 | A | 3/2019 |
| KR | 20190067565 | A | 6/2019 |
| WO | WO2016175117 | A1 | 11/2016 |

* cited by examiner

CIRCUIT AND METHOD FOR PREVENTING SCREEN FLICKERING, DRIVE CIRCUIT FOR DISPLAY PANEL, AND DISPLAY APPARATUS

CROSS-REFERENCE TO RELATED APPLICATIONS

This application is a 371 of PCT Application No. PCT/CN2020/097522, filed on Jun. 22, 2020, which claims priority to Chinese Patent Application No. 201910561102.3, filed on Jun. 26, 2019 and titled "CIRCUIT AND METHOD FOR PREVENTING SCREEN FLICKERING, DRIVE CIRCUIT, AND DISPLAY APPARATUS", which are incorporated herein by reference in their entireties.

TECHNICAL FIELD

The present disclosure relates to the field of display technology, and particularly, to circuit and method for preventing screen flickering, a drive circuit for a display panel, and a display apparatus.

BACKGROUND

With the development of display technologies and the improvement of people's material life, the requirements for all aspects of a display are getting higher and higher. Eliminating various display defects is an important way to improve the quality of the display. The display defects include a phenomenon of screen flickering (also called white flickering) of a liquid crystal display.

SUMMARY

Embodiments of the present disclosure provides circuit and method for preventing screen flickering, a drive circuit for a display panel, and a display apparatus In one aspect, an embodiment of the present disclosure provides a circuit for preventing screen flickering, which is applicable to a drive circuit for a display panel, the drive circuit including a gate drive circuit, where the circuit for preventing screen flickering includes:

a control sub-circuit configured to control the gate drive circuit to output a gate cut-off level during a power-on period of the display panel.

Optionally, the gate drive circuit includes a noise reduction module which is configured to pull an output level of the gate drive circuit to the gate cut-off level when a noise reduction voltage signal received by the noise reduction module is a turn-on level; and the control sub-circuit is configured to control the noise reduction voltage signal outputted to the noise reduction module to be the turn-on level during the power-on period.

Optionally, the control sub-circuit is configured to output an external input voltage signal of the drive circuit as the noise reduction voltage signal to the noise reduction module during the power-on period.

Optionally, the gate drive circuit includes a first noise reduction module and a second noise reduction module, the drive circuit further includes a level shift circuit, and the level shift circuit is configured to provide a first noise reduction voltage signal for the first noise reduction module and provide a second noise reduction voltage signal for the second noise reduction module; and the circuit for preventing screen flickering further includes a determination sub-circuit configured to determine whether it is in the power-on period based on the first noise reduction voltage signal and the second noise reduction voltage signal.

Optionally, the determination sub-circuit is configured to determine whether voltages of the first noise reduction voltage signal and the second noise reduction voltage signal are equal, and it is in the power-on period if the voltages of the first noise reduction voltage signal and the second noise reduction voltage signal are equal; and the control sub-circuit is configured to control the gate drive circuit to output the gate cut-off level when the voltages of the first noise reduction voltage signal and the second noise reduction voltage signal are equal.

Optionally, the determination sub-circuit includes:

a first comparator and a second comparator, where each of the first comparator and the second comparator includes: a non-inverting input terminal, an inverting input terminal and an output terminal; both the non-inverting input terminal of the first comparator and the inverting input terminal of the second comparator are electrically connected to a first noise reduction voltage signal output terminal of the level shift circuit; both the inverting input terminal of the first comparator and the non-inverting input terminal of the second comparator are electrically connected to a second noise reduction voltage signal output terminal of the level shift circuit; and an OR gate, where two input terminals of the OR gate are respectively electrically connected to the output terminal of the first comparator and the output terminal of the second comparator, and an output terminal of the OR gate is electrically connected to a control terminal of the control sub-circuit;

where the first noise reduction signal output terminal is configured to output the first noise reduction voltage signal, and the second noise reduction signal output terminal is configured to output the second noise reduction voltage signal.

Optionally, the control sub-circuit includes:

a first selector, where two input terminals of the first selector are respectively electrically connected to the first noise reduction voltage signal output terminal of the level shift circuit and an external input voltage signal input terminal of a power management integrated circuit of the display panel; a control terminal of the first selector is electrically connected to an output terminal of the determination sub-circuit; the first selector is configured to output one of the first noise reduction voltage signal and the external input voltage signal through an output terminal of the first selector under control of an output signal of the determination sub-circuit; and a second selector, where two input terminals of the second selector are respectively electrically connected to the second noise reduction voltage signal output terminal of the level shift circuit and the external input voltage signal input terminal of the power management integrated circuit; a control terminal of the second selector is electrically connected to the output terminal of the determination sub-circuit; the second selector is configured to output one of the second noise reduction voltage signal and the external input voltage signal through an output terminal of the second selector under control of the output signal of the determination sub-circuit;

where the external input voltage signal input terminal is configured to receive the external input voltage signal provided to the drive circuit for the display panel.

In another aspect, an embodiment of the present disclosure provides a drive circuit for a display panel, the drive circuit including any of the foregoing circuit for preventing screen flickering.

In yet another aspect, an embodiment of the present disclosure provides a display apparatus, which includes the drive circuit as described above.

In still another aspect, an embodiment of the present disclosure provides a method for preventing screen flickering, which is applicable to a drive circuit for a display panel, the drive circuit including a gate drive circuit, where the method includes:

controlling the gate drive circuit to output a gate cut-off level during a power-on period of the display panel.

Optionally, the gate drive circuit includes a noise reduction module which is configured to pull an output level of the gate drive circuit to the gate cut-off level when a noise reduction voltage signal received by the noise reduction module is a turn-on level; and said controlling the gate drive circuit to output the gate cut-off level during the power-on period of the display panel includes:

controlling the noise reduction voltage signal outputted to the noise reduction module to be the turn-on level during the power-on period.

Optionally, said controlling the noise reduction voltage signal outputted to the noise reduction module to be the turn-on level during the power-on period includes:

outputting an external input voltage signal of the drive circuit as the noise reduction voltage signal to the noise reduction module during the power-on period.

Optionally, the gate drive circuit includes a first noise reduction module and a second noise reduction module, the drive circuit further includes a level shift circuit, and the level shift circuit is configured to provide a first noise reduction voltage signal for the first noise reduction module and provide a second noise reduction voltage signal for the second noise reduction module; and the method may further include:

determining whether it is in the power-on period based on the first noise reduction voltage signal and the second noise reduction voltage signal.

Optionally, said determining whether it is in the power-on period based on the first noise reduction voltage signal and the second noise reduction voltage signal includes:

determining whether voltages of the first noise reduction voltage signal and the second noise reduction voltage signal are equal, where it is in the power-on period if the voltages of the first noise reduction voltage signal and the second noise reduction voltage signal are equal; and said controlling the gate drive circuit to output the gate cut-off level during the power-on period of the display panel includes:

controlling the gate drive circuit to output the gate cut-off level when the voltages of the first noise reduction voltage signal and the second noise reduction voltage signal are equal.

BRIEF DESCRIPTION OF THE DRAWINGS

In order to describe technical solutions in embodiments of the present disclosure more clearly, the following briefly introduces accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

For clearer descriptions of the objects, technical solutions and advantages of the present disclosure, embodiments of the present disclosure are described in detail below in combination with the accompanying drawings.

In order to facilitate the understanding of the schemes provided in the present application, a display is briefly described below first.

The display includes a display panel and a drive circuit for the display panel. The display panel functions to emit light and display images. The drive circuit is configured to provide signals required for displaying of the display panel and control, through the signals, the display panel to operate.

Different types of displays have display panels with different structures. Taking a liquid crystal display as an example, a display panel of the liquid crystal display includes an array substrate and a color filter substrate that are oppositely arranged to form a cell, and a liquid crystal layer sandwiched between the array substrate and the color filter substrate. The array substrate includes gate lines and data lines, the gate lines and the data lines intersecting with each other to form a plurality of sub-pixel regions, where a pixel drive circuit is arranged in each sub-pixel region and is configured to control a corresponding pixel unit to emit light. Exemplarily, the pixel drive circuit includes a thin film transistor (TFT). A gate electrode of the TFT is connected to the gate line, a source electrode of the TFT is connected to the data line, and a drain electrode of the TFT is connected to a pixel electrode. The on-off of the TFT can be controlled by the corresponding gate line, thereby controlling whether to write a signal from the data line into the pixel electrode. Here, in addition to the liquid crystal display, the display may also be other types of displays such as an organic light-emitting diode display.

The drive circuit functions to provide signals for the gate lines and the data lines to control the display panel to operate. The drive circuit generally includes a timer control register (TCON) circuit, a gate drive circuit, and a source drive circuit. The TCON circuit is configured to provide a variety of voltage signals that support the operation of the gate drive circuit and the source drive circuit, such as a start signal (STV), a clock signal (CLK), a low-level signal (VSS), a noise reduction voltage signal (VDDO/VDDE). The gate drive circuit and the source drive circuit generate a gate drive signal and a source drive signal respectively by using these signals outputted by the TCON circuit.

Optionally, each of the TCON circuit, the source drive circuit and the gate drive circuit can be implemented by using an integrated circuit board. Furthermore, the gate drive circuit can be arranged in the display panel in a form of a shift register, i.e., a gate on array (GOA), that is, a shift register unit (GOA unit) in the display panel is used as the gate drive circuit.

Figure 1:
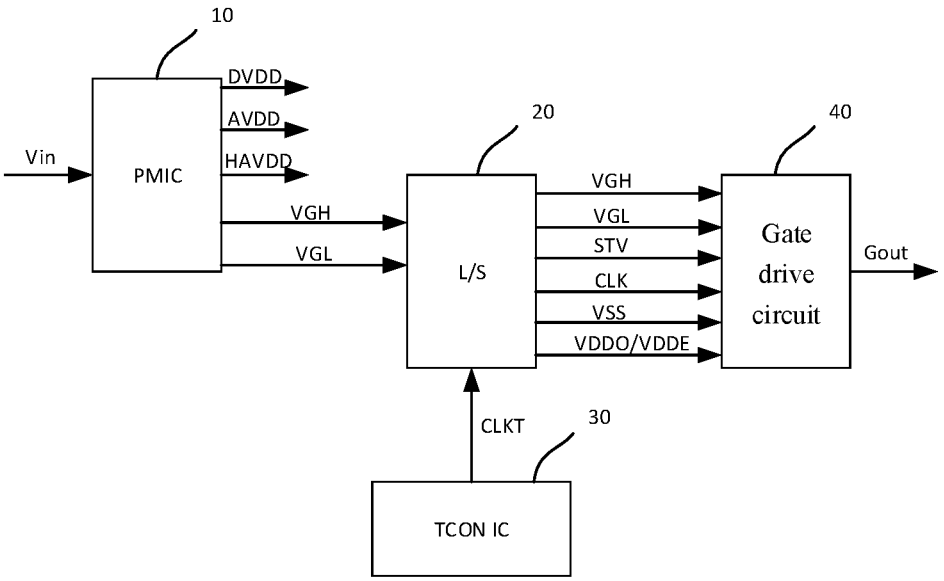
FIG. 1 is a schematic structural diagram showing a part of a drive circuit for a display panel.

FIG. 1 is a schematic structural diagram showing a part of a drive circuit. This schematic diagram mainly shows a part of a TCON circuit related to gate drive, but does not show a part of the TCON circuit related to source drive (such as a Gamma circuit). Referring to FIG. 1, the drive circuit includes a power management integrated circuit (PMIC) 10, a level shift (L/S) circuit 30, and a TCON IC 30 (hereinafter referred to as TCON), where the L/S circuit 20 is electrically connected to the PMIC 10 and the TCON 30.

The PMIC 10 is configured to output signals such as a digital power signal (DVDD), an analog power signal (AVDD), a half-analog power signal (HAVDD), a gate high level signal (VGH) and a gate low level signal (VGL) based on an input signal Vin. A crystal oscillator which can generate a clock signal CLKT (the clock signal has a low level of 0V and a high level of 3.3V) is integrated inside the TCON 30. The L/S circuit 20 is configured to generate STV, CLK, VSS, VDDO, VDDE, VGL, VGH and other signals based on signals outputted by the PMIC and the TCON and provide these generated signals to a gate drive circuit 40. The gate drive circuit 40 outputs a signal (Gout signal) to gate lines under control of signals outputted by the L/S circuit 20, where the Gout signal is VGL or VGH during an operating period. Here, the VGL and VGH outputted by the L/S circuit 20 to the gate drive circuit 40 are just the VGL and VGH outputted by the PMIC 10 to the L/S circuit 20. The gate drive circuit 40 determines, according to the level of the CLK signal, to which gate line of the display panel the VGH is outputted and to which gate line the VGL is outputted. It should be noted that, in addition to performing the gate drive function, the TCON also needs to perform a source drive function, for example, demodulate received data information and transmit it to the source drive circuit.

Exemplarily, the gate drive circuit 40 includes a plurality of cascaded GOA units. Each GOA unit generally consists of a plurality of switches (such as thin film transistors (TFTs)) and a capacitor (C). For example, a 10T2C circuit consisting of 10 TFTs and 2 capacitors, or a circuit consisting of more TFTs and capacitors is adopted. One GOA unit generally includes an input module, a reset module, a noise reduction module, an output module and the like. The input module outputs an electrical signal to the output module according to a received output signal of the L/S circuit 20. The output module outputs a gate turn-on level or a gate cut-off level to the display panel based on the electrical signal outputted by the input module. The noise reduction module is connected between the input module and the output module and configured to maintain a voltage at an input terminal of the output module when the noise reduction module operates, such that the output module outputs the gate cut-off level. In addition to the above-mentioned modules, the gate drive circuit 40 may further include a pull-up module, a pull-down module, etc. In a GOA unit including the pull-up module and the pull-down module, the noise reduction module plays the same role as in the aforementioned GOA unit.

The noise reduction module is controlled by a noise reduction voltage signal, and operates when the noise reduction voltage signal is a turn-on level so that the corresponding GOA unit outputs the gate cut-off level (VGL or VGH) to the gate line of the display panel. The gate line outputs the gate cut-off level to the TFT connected to the gate line, and controls the TFT to be in a cut-off state.

It is worth noting that in one GOA unit of the gate drive circuit 40, there are usually two noise reduction modules, which can operate alternately. The two noise reduction modules are controlled by VDDO and VDDE respectively. For example, the two noise reduction modules are respectively turned on when VDDO is a high level and VDDE is a high level, to pull an output of the gate drive circuit 40 down to VGL while achieving noise reduction. That is, the gate driving circuit 40 includes a first noise reduction module and a second noise reduction module, where the first noise reduction module is controlled by a first noise reduction voltage signal, and the second noise reduction module is controlled by a second noise reduction voltage signal.

Taking a high level as a turn-on level as an example, the noise reduction module operates when the noise reduction voltage signal is the high level, to pull the output of the gate drive circuit down to VGL, thereby controlling the TFT of the display panel to be turned off, that is, controlling a pixel drive circuit of the display panel not to operate. In the related art, during the power-on period of the display panel, the noise reduction voltage signal is a low level, so the noise reduction module cannot be controlled to pull down the output of the gate drive circuit. Meanwhile, an electric leakage phenomenon (the output of the gate drive circuit has leakage current) may occur in the gate drive circuit. The leakage current accumulates on a gate electrode of the TFT in the display panel, such that the TFT in the display panel is turned on, and a pixel of the display panel emits light, resulting in screen flickering during startup.

Figure 2:
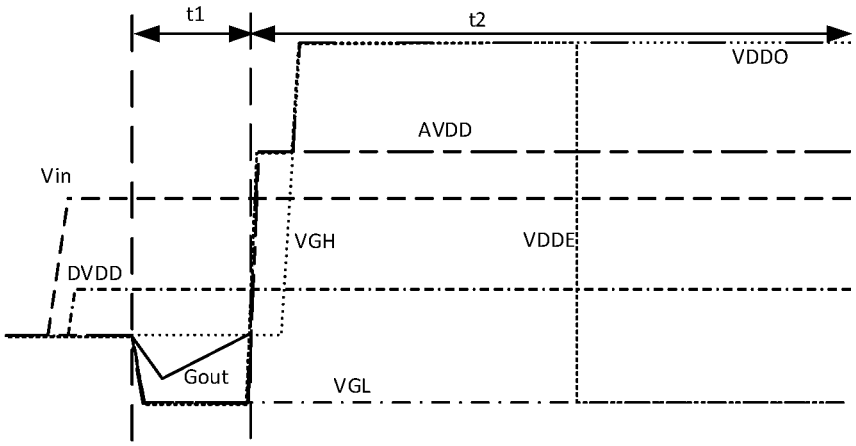
FIG. 2 is a signal sequence diagram of the drive circuit shown in FIG. 1.
Figure 3:
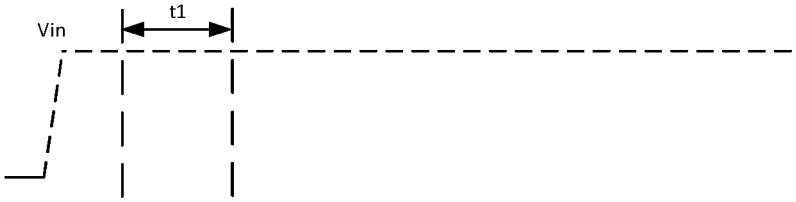
FIGS. 3 to 10 are schematic sequence diagrams of various signals shown in FIG. 2 respectively.
Figure 4:
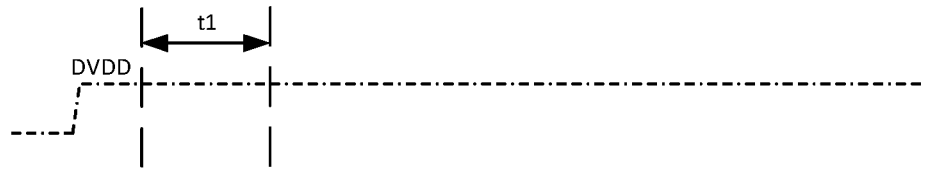
Figure 5:
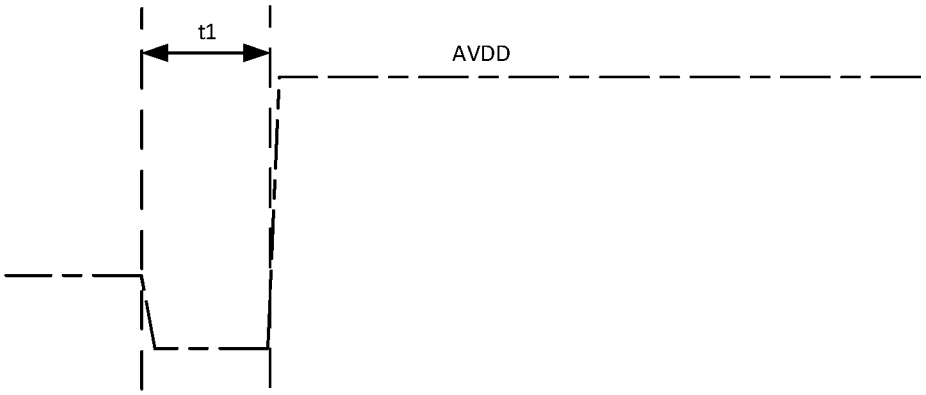
Figure 6:
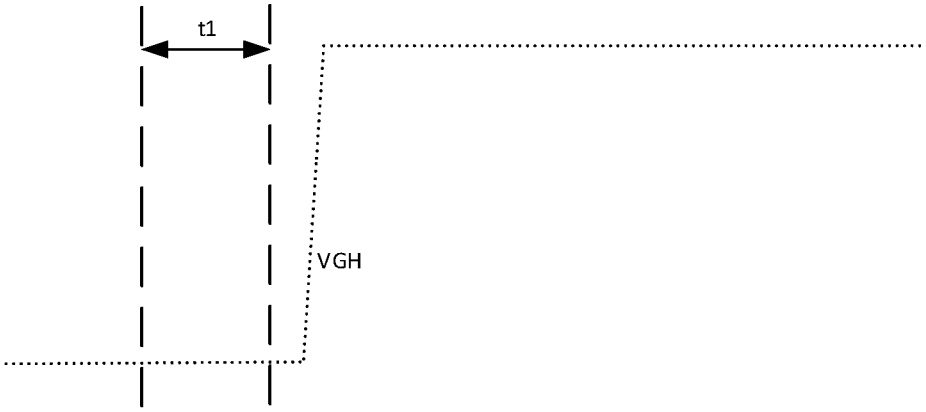
Figure 7:
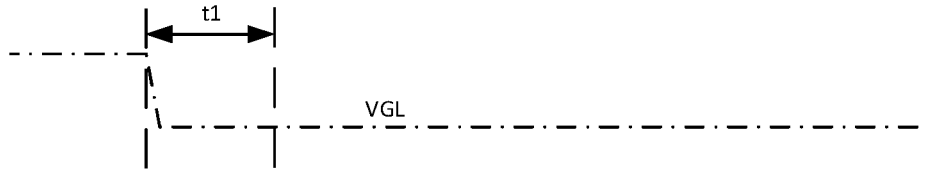
Figure 8:
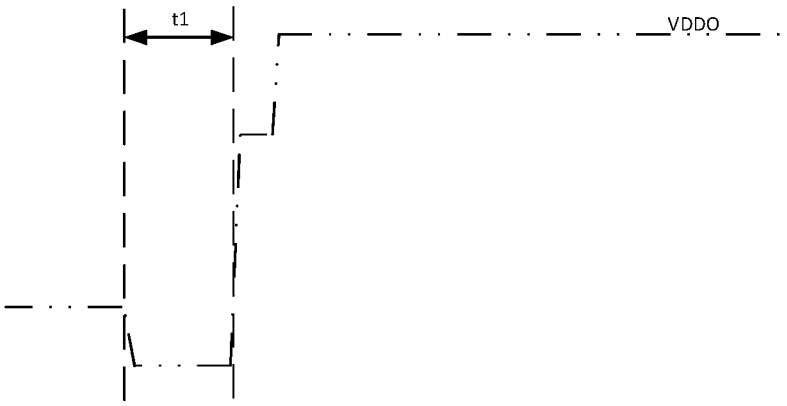
Figure 9:
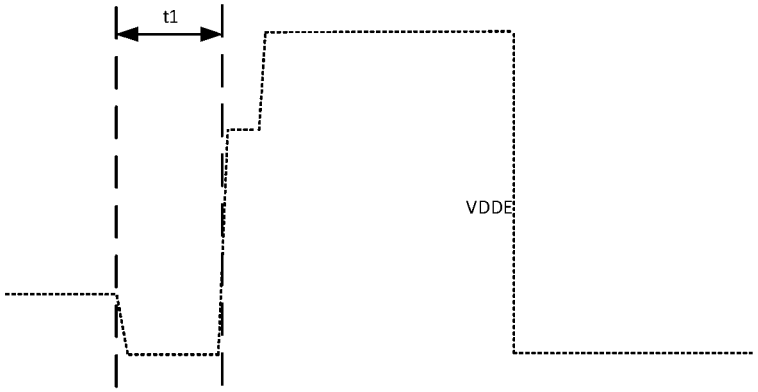
Figure 10:
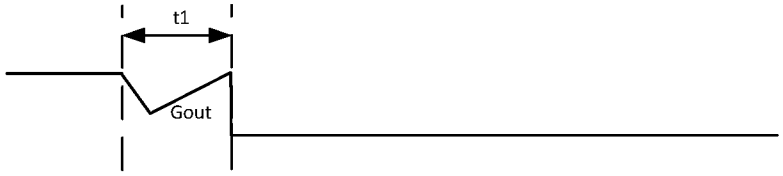

FIG. 2 is a signal sequence diagram of the drive circuit shown in FIG. 1. FIGS. 3 to 10 are schematic sequence diagrams of various signals shown in FIG. 2 respectively. Referring to FIGS. 2-10, in a power-on period t1, the PMIC 10 of the drive circuit first loads a Vin signal. The PMIC 10 generates a DVDD signal after Vin is input, where the DVDD signal is used as an operating voltage for the PMIC 10, the L/S circuit 20, the TCON 30, etc.; and the PMIC 10 and the L/S circuit 20 generate other signals based on the operating voltage.

As shown in FIGS. 2-10, in the power-on period t1, an output of the gate drive circuit, a Gout signal (close to 0V), is higher than a VGL signal (that is, a gate cut-off signal). The TFT in the display panel may be in a certain turn-on state under the action of the Gout signal, and after pixel electrodes are charged subsequently, pixels will emit light, resulting in a screen flickering phenomenon.

Figure 11:
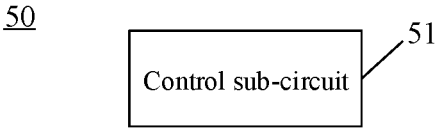
FIG. 11 is a structural block diagram of a circuit for preventing screen flickering provided by an embodiment of the present disclosure.

FIG. 11 is a structural block diagram of a circuit for preventing screen flickering provided by an embodiment of the present disclosure. Referring to FIG. 11, the circuit 50 for preventing screen flickering is applicable to a drive circuit for a display panel. The circuit 50 for preventing screen flickering includes:

a control sub-circuit 51 configured to control a gate drive circuit 40 to output a gate cut-off level during a power-on period of the display panel.

In the embodiment of the present disclosure, the power-on period refers to a stage in which the drive circuit for the display panel is connected to a power source and generates various drive signals under the action of the power source. The gate cut-off level refers to a level signal that controls the TFT in the display panel to be in a cut-off state. That is, the gate cut-off level is a level signal that controls a pixel drive circuit in the display panel not to operate, so that a corresponding pixel unit does not emit light.

In this scheme, the gate drive circuit for the display panel is controlled to output the gate cut-off level during the power-on period and the gate cut-off level is provided to the TFT in the display panel, such that the TFT in the display panel is in a cut-off state during the power-on period. When the TFT in the display panel is in the cut-off state, the pixel unit of the display panel will not emit light, thereby eliminating the screen flickering phenomenon.

In a possible implementation, the gate drive circuit 40 includes a noise reduction module which is configured to pull an output level of the gate drive circuit 40 to the gate cut-off level when a received noise reduction voltage signal is a turn-on level. The control sub-circuit 51 is configured to control the noise reduction voltage signal outputted to the noise reduction module to be the turn-on level during the power-on period.

Since the turn-on level is provided to the noise reduction module of the gate drive circuit 40 during the power-on period, the turn-on level can control the noise reduction module to operate, and the output of the gate drive circuit 40 can be pulled to the gate cut-off level by the noise reduction module during the power-on period.

The aforementioned noise reduction module includes a switch which is controlled by the noise reduction voltage signal. When the noise reduction voltage signal is the turn-on level, the switch in the drive noise reduction module is driven to be turned on. When the switch in the noise reduction module in the gate drive circuit 40 is turned on, the gate drive circuit 40 outputs the gate cut-off level to the TFT of the display panel. For example, the noise reduction module includes a plurality of TFTs, which have different functions. Among the plurality of TFTs, at least one TFT functions as the aforementioned switch, that is, is turned on or off under control of the noise reduction voltage signal.

Here, the gate cut-off level can be the aforementioned VGL or VGH. Depending on different types of TFTs, the gate cut-off levels are also different. For example, when the TFT is an NMOS TFT, the gate cut-off level is VGL; and when the TFT is a PMOS TFT, the gate cut-off level is VGH.

In an implementation of the embodiment of the present disclosure, the control sub-circuit 51 is configured to output an external input voltage signal (for example, Vin in FIG. 1) of the drive circuit as the noise reduction voltage signal (VDDO/VDDE) to the noise reduction module during the power-on period.

In the implementation, the external input voltage signal Vin of the drive circuit is outputted to the gate drive circuit instead of the noise reduction voltage signal of the noise reduction module during the power-on period, such that a control switch of the noise reduction module can be turned on during the power-on period and the noise reduction module operates. Here, since the external input voltage signal Vin provided to the drive circuit of the display panel is a signal that exists at the earliest time, this signal can be provided to the noise reduction module of the gate drive circuit during the power-on period.

Taking the NMOS TFT used as the switch connected to a gate line of the display panel as an example, the noise reduction voltage signal (VDDO/VDDE) is inputted into the switch in the noise reduction module of the gate drive circuit 40 during an operating period of the display panel, so as to reduce an operating voltage of the switch, thereby achieving the purpose of noise reduction. However, as can be seen from the sequence diagram shown in FIG. 2, during the power-on period, the noise reduction voltage signal (VDDO/VDDE) is a low level following VGL, so the switch in the noise reduction module in the gate drive circuit 40 cannot be turned on. Meanwhile, an electric leakage phenomenon may occur in the gate drive circuit 40. The leakage current accumulates on the gate electrode of the TFT in the display panel, and finally the TFT in the display panel can be turned on, resulting in screen flickering during startup. In order to avoid screen flickering, in the present disclosure, the input voltage signal (Vin) is used to replace the noise reduction voltage signal (VDDO/VDDE) during the power-on period. The input voltage signal (Vin) is a high level and can turn on the switch in the noise reduction module. The external input voltage signal of the display panel is outputted to the gate drive circuit 40 during the power-on period instead of the noise reduction voltage signal of the gate drive circuit, such that the switch of the gate drive circuit 40 can be turned on during the power-on period, the VGL signal is outputted to the TFT in the display panel, and the TFT in the display panel is kept turned off, thereby eliminating the screen flickering phenomenon.

Of course, the input voltage signal here can also be replaced by signals other than Vin, as long as it is a high-level signal and exists before the power-on period, which is not limited in the present disclosure.

During the operating period of the display panel, the control sub-circuit 51 is configured to control the noise reduction voltage signal (VDDO/VDDE) to be outputted to the noise reduction module, so that the gate drive circuit 40 can operate normally during the operating period.

As mentioned above, the gate drive circuit 40 has two noise reduction modules, namely the first noise reduction module and the second noise reduction module. The first noise reduction module is configured to receive a first noise reduction voltage signal outputted by the level shift circuit 20 during the operating period of the display panel. The second noise reduction module is configured to receive a second noise reduction voltage signal outputted by the level shift circuit 20 during the operating period of the display panel. That is, the level shift circuit 20 is configured to provide the first noise reduction voltage signal for the first noise reduction module and provide the second noise reduction voltage signal for the second noise reduction module. Here, the operating period refers to a period in which the display panel is operating normally to display images. When the aforementioned power-on period expires, the display panel enters the operating period.

Figure 12:
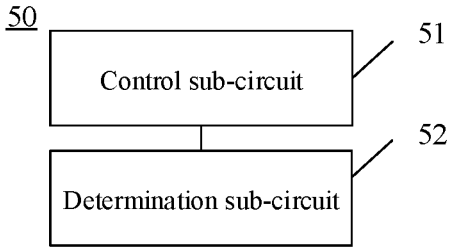
FIG. 12 is a structural block diagram of a circuit for preventing screen flickering provided by an embodiment of the present disclosure.

FIG. 12 is a schematic structural diagram of a circuit for preventing screen flickering provided by an embodiment of the present disclosure. Referring to FIG. 12, the circuit for preventing screen flickering may further include a determination sub-circuit 52, which is configured to determine whether it is in the power-on period based on the first noise reduction voltage signal and the second noise reduction voltage signal.

In the gate drive circuit, there are 2 types of noise reduction modules. Correspondingly, there are two noise reduction voltage signals provided to the noise reduction modules, which are the aforementioned VDDO and VDDE. As can be seen from the time sequence in FIG. 2, voltages of the two noise reduction voltage signals are equal during the power-on period t1, but are not equal during the operating period t2. Therefore, whether it is in the power-on period may be determined by determining whether the voltages of the two noise reduction voltage signals are equal. In case of determining that it is in the power-on period, the aforementioned scheme is adopted to eliminate screen flickering to ensure the normal operation of the display panel.

Exemplarily, the determination sub-circuit 52 is configured to determine whether the voltages of the first noise reduction voltage signal and the second noise reduction voltage signal are equal. As mentioned above, whether it is in the power-on period may be determined by determining whether the voltages of the two noise reduction voltage signals are equal. It means that it is in the power-on period if the voltages of the first noise reduction voltage signal and the second noise reduction voltage signal are equal. Correspondingly, the control sub-circuit 51 is configured to control the gate drive circuit 40 to output the gate cut-off level when the voltages of the first noise reduction voltage signal and the second noise reduction voltage signal are equal.

Here, an input terminal of the determination sub-circuit 52 is electrically connected to an output terminal of the L/S circuit 20 to acquire two noise reduction voltage signals (VDDO/VDDE) outputted by the L/S circuit 20.

An input terminal of the control sub-circuit 51 is electrically connected to the output terminal of the L/S circuit 20 to acquire two noise reduction voltage signals (for example, VDDO/VDDE) outputted by the L/S circuit 20. Meanwhile, the input terminal of the control sub-circuit 51 is also electrically connected to an input terminal of the PMIC 10 to acquire an external input voltage signal (for example, Vin).

Here, a determination result of the determination sub-circuit 52 can be represented by high and low levels. For example, if the determination sub-circuit 52 outputs a low level, it means that the determination result is that the voltages of the two noise reduction voltage signals are equal; and if the determination sub-circuit 52 outputs a high level, it means that the determination result is that the voltages of the two noise reduction voltage signals are not equal.

Figure 13:
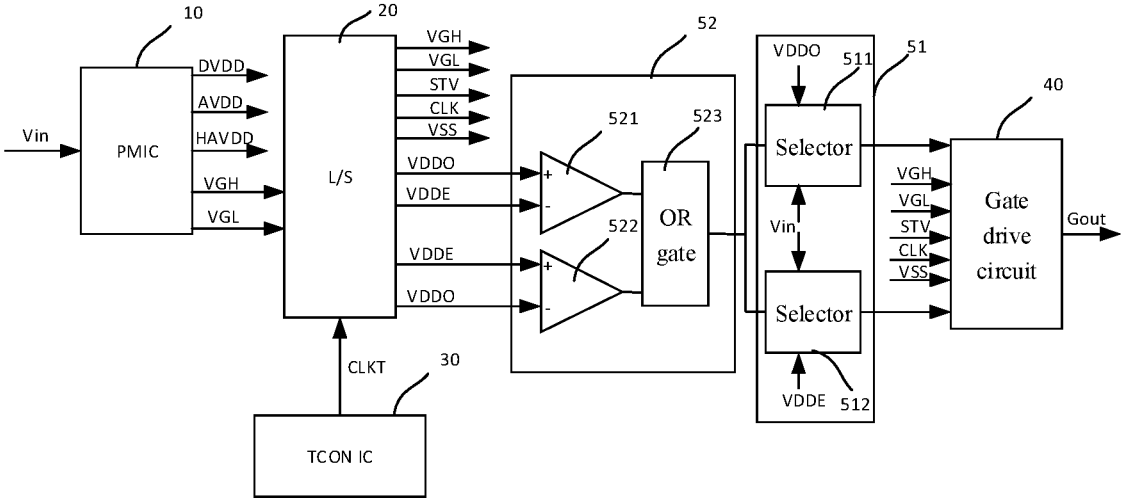
FIG. 13 is a schematic diagram showing a detailed structure of a circuit for preventing screen flickering provided by an embodiment of the present disclosure.

FIG. 13 is a schematic diagram of a detailed structure of a circuit for preventing screen flickering provided by an embodiment of the present disclosure. Referring to FIG. 13, the determination sub-circuit 52 may include a first comparator 521, a second comparator 522, and an OR gate 523.

Each of the first comparator 521 and the second comparator 522 includes a non-inverting input terminal (represented by "+" in FIG. 13), an inverting input terminal (represented by "−" in FIG. 13) and an output terminal. Both the non-inverting input terminal of the first comparator 521 and the inverting input terminal of the second comparator 522 are electrically connected to a first noise reduction voltage signal output terminal of the L/S circuit 20 and configured to receive a first noise reduction voltage signal outputted by the L/S circuit 20. Both the inverting input terminal of the first comparator 521 and the non-inverting input terminal of the second comparator 522 are electrically connected to a second noise reduction voltage signal output terminal of the L/S circuit 20 and configured to receive a second noise reduction voltage signal outputted by the L/S circuit 20.

Two input terminals of the OR gate 523 are respectively electrically connected to the output terminal of the first comparator 521 and the output terminal of the second comparator 522, and an output terminal of the OR gate 523 is electrically connected to a control terminal of the control sub-circuit 51.

Assuming that voltages of two input signals of the comparator are VIN+ (the voltage of the signal at the non-inverting input terminal) and VIN− (the voltage of the signal at the inverting input terminal), "1" (low level) is outputted in the case of VIN+>VIN−; and "0" (high level) is outputted in the case of VIN+<VIN−. Therefore, when the voltages of the two noise reduction voltage signals are equal, the two comparators both output 0, and the OR gate outputs 0; and when the voltages of the two noise reduction voltage signals are not equal, the two comparators output 0 and 1 respectively, and the OR gate outputs 1. The output of the OR gate indicates whether the voltages of the two noise reduction voltage signals are equal, so as to determine whether it is in the power-on period.

The first comparator 521 and the second comparator 522 may be the same. Each of the first comparator 521 and the second comparator 522 may be implemented by using a differential amplifier.

Referring to FIG. 13 again, the control sub-circuit 51 may include a first selector 511 and a second selector 512.

The first selector 511 includes a control terminal, two input terminals and an output terminal. Two input terminals of the first selector 511 are respectively electrically connected to the first noise reduction voltage signal output terminal of the L/S circuit 20 and an external input voltage signal input terminal of the PMIC 10 of the display panel. The control terminal of the first selector 511 is electrically connected to an output terminal of the determination sub-circuit 52. The first selector 511 is configured to output one of the first noise reduction voltage signal and the external input voltage signal through the output terminal of the first selector 511 under control of an output signal of the determination sub-circuit 52.

The second selector 512 includes a control terminal, two input terminals and an output terminal. Two input terminals of the second selector 512 are respectively electrically connected to the second noise reduction voltage signal output terminal of the L/S circuit 20 and the external input voltage signal input terminal of the PMIC 10. The control terminal of the second selector 512 is electrically connected to the output terminal of the determination sub-circuit 52. The second selector 512 is configured to output one of the second noise reduction voltage signal and the external input voltage signal through the output terminal of the second selector 512 under control of the output signal of the determination sub-circuit 52.

The first noise reduction signal output terminal is configured to output the first noise reduction voltage signal, and the second noise reduction signal output terminal is configured to output the second noise reduction voltage signal. For example, the first noise reduction voltage signal output terminal may be a VDDO noise reduction voltage signal output terminal, and the second noise reduction voltage signal output terminal may be a VDDE noise reduction voltage signal output terminal. The external input voltage signal input terminal is configured to receive the external input voltage signal of the display panel.

In this implementation, the output of two noise reduction voltage signals is controlled by the two selectors. When the output of the determination sub-circuit indicates that the voltages of the two noise reduction voltage signals are equal, the selectors select the external input voltage signal of the drive circuit for output, that is, Vin is adopted to control the noise reduction module to operate during the power-on period. When the output of the determination sub-circuit indicates that the two noise reduction voltage signals are not equal, the selectors select one of the two noise reduction voltage signals for output, that is, VDDO and VDDE are adopted respectively to control the first noise reduction module and the second noise reduction module to operate. There always is a high-level in VDDO and VDDE, such that one of the noise reduction modules can be kept to operate.

The above scheme eliminates screen flickering during startup, and ensures the normal operation of the display panel during operation.

The first selector 511 and the second selector 512 may be the same. The first selector 511 and the second selector 512 can also be referred to as high-low level converters because they are controlled by the output signal of the determination sub-circuit 52, and triggered at a low level (i.e., valid when "0" (low level) is input and Vin is used as output (i.e., high level is used as output), and invalid when "1" (high level) is input and VDDO/VDDE is used as output (i.e., low level is used as output)).

In combination with the detailed structure shown in FIG. 13, it can be seen that the comparators, a gate circuit and the selectors are additionally provided just on the basis of the original circuit, in order to eliminate screen flickering. The circuit design is simple and the cost is low. Meanwhile, this scheme has good versatility and can be used in existing drive circuits for various displays.

Figure 14:
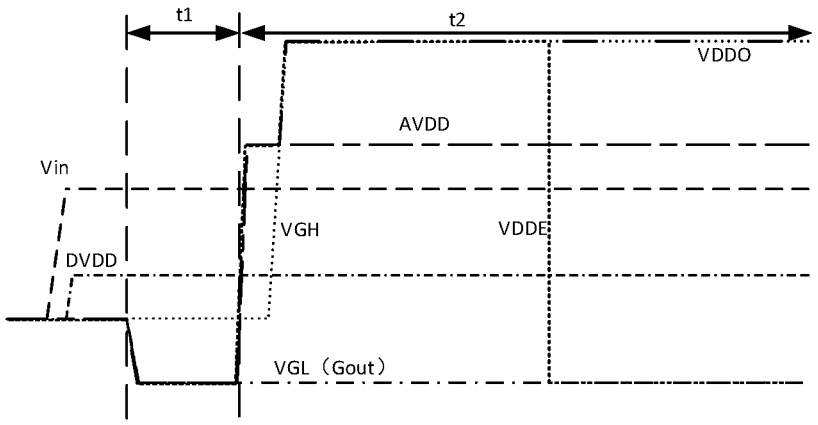
FIGS. 14-15 are signal sequence diagrams of the drive circuit after using a circuit for preventing screen flickering provided by the present disclosure.
Figure 15:
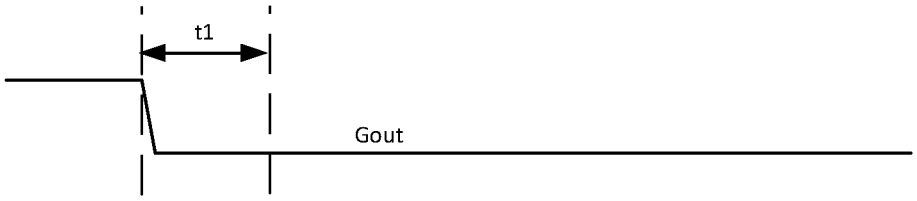

FIGS. 14-15 are signal sequence diagrams of a drive circuit after using the circuit for preventing screen flickering provided by the present disclosure. Referring to FIG. 14 and FIG. 15, after the circuit for preventing screen flickering is adopted, during the power-on period t1, the Gout signal is the VGL signal, the TFT in the display panel will be in a cut-off state under the action of the Gout signal, and no screen flickering will occur in the display panel. In the power-on period t1, the Gout signal can be VGL or VGH, and the Gout signal is VGL is just an example here.

An embodiment of the present disclosure further provides a drive circuit for a display panel. The drive circuit includes a gate drive circuit and the circuit for preventing screen flickering shown in any one of FIGS. 11-13.

In this scheme, the gate drive circuit of the display panel is controlled to output a gate cut-off level during the power-on period, and the gate cut-off level is provided to gate lines of the display panel such that TFTs connected to the gate lines in the display panel are in a cut-off state during the power-on period. When the TFTs in the display panel are in the cut-off state, pixel units of the display panel will not emit light, thereby eliminating the screen flickering phenomenon during startup.

Optionally, the circuit for preventing screen flickering may be integrated on a logic board of a display. The gate drive circuit may be a GOA unit on the display panel, or the gate drive circuit may be a separate integrated circuit.

An embodiment of the present disclosure further provides a display apparatus, which includes the drive circuit as described above.

In the embodiment of the present disclosure, the display apparatus provided by the embodiment of the present disclosure may be any product or component having a display function, such as a mobile phone, a tablet computer, a television, a display, a notebook computer, a digital photo frame and a navigator.

In this scheme, the gate drive circuit of the display panel is controlled to output a gate cut-off level during the power-on period, and the gate cut-off level is provided to TFTs in the display panel such that TFTs in the display panel are in a cut-off state during the power-on period. When the TFTs in the display panel are in the cut-off state, pixel units of the display panel will not emit light, thereby eliminating the screen flickering phenomenon during startup.

Figure 16:
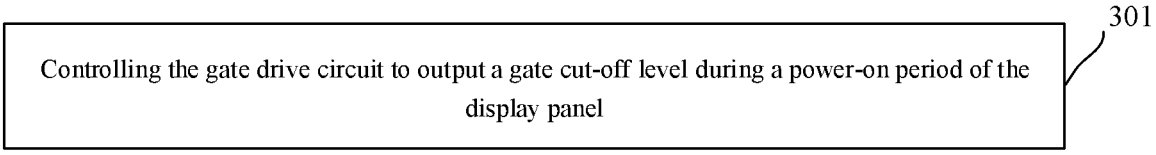
FIG. 16 is a flowchart of a method for preventing screen flickering provided by an embodiment of the present disclosure.

FIG. 16 is a flowchart of a method for preventing screen flickering provided by an embodiment of the present disclosure. The method is implemented by using the circuit for preventing screen flickering shown in any one of FIGS. 11 to 13, and is applicable to a drive circuit for a display panel. The drive circuit includes a gate drive circuit. Referring to FIG. 16, the method includes the following step.

In step 301, the gate drive circuit is controlled to output a gate cut-off level during a power-on period of the display panel.

In this scheme, the gate drive circuit of the display panel is controlled to output the gate cut-off level during the power-on period, and the gate cut-off level is provided to TFTs in the display panel such that the TFTs in the display panel are in a cut-off state during the power-on period. When the TFTs in the display panel are in the cut-off state, pixel units of the display panel will not emit light, thereby eliminating the screen flickering phenomenon during startup.

In an implementation of the embodiment of the present disclosure, the gate drive circuit includes a noise reduction module. The noise reduction module is configured to pull an output level of the gate drive circuit to a gate cut-off level under control of a noise reduction voltage signal when the noise reduction voltage signal is a turn-on level. Correspondingly, said controlling the gate drive circuit of the display panel to output the gate cut-off level during the power-on period of the display panel includes: controlling the noise reduction voltage signal outputted to the noise reduction module to be the turn-on level during the power-on period.

In an implementation of the embodiment of the present disclosure, said controlling the noise reduction voltage signal outputted to the noise reduction module to be the turn-on level during the power-on period includes: outputting an external input voltage signal of the drive circuit as the noise reduction voltage signal to the noise reduction module during the power-on period.

In an implementation of the embodiment of the present disclosure, the gate drive circuit includes a first noise reduction module and a second noise reduction module. The drive circuit further includes a level shift circuit, which is configured to provide a first noise reduction voltage signal for the first noise reduction module and a second noise reduction voltage signal for the second noise reduction module. Correspondingly, the first noise reduction module is controlled by the first noise reduction voltage signal during the operating period, and the second noise reduction module is controlled by the second noise reduction voltage signal during the operating period. The method further includes: determining whether it is in the power-on period based on the first noise reduction voltage signal and the second noise reduction voltage signal.

In an implementation of the embodiment of the present disclosure, said determining whether it is in the power-on period based on the first noise reduction voltage signal and the second noise reduction voltage signal includes: determining whether voltages of the first noise reduction voltage signal and the second noise reduction voltage signal are equal, where it is in the power-on period if the voltages of the first noise reduction voltage signal and the second noise reduction voltage signal are equal. Correspondingly, said controlling the gate drive circuit of the display panel to output the gate cut-off level during the power-on period includes: controlling the gate drive circuit to output the gate cut-off level when the voltages of the first noise reduction voltage signal and the second noise reduction voltage signal are equal.

In an implementation of the embodiment of the present disclosure, the method may further include: controlling a noise reduction voltage signal (VDDO/VDDE) to be outputted to the noise reduction module during the operating period of the display panel, so that the gate drive circuit can normally operate during the operating period.

The foregoing descriptions are merely exemplary embodiments of the present disclosure, and are not intended to limit the present disclosure. Any modifications, equivalent substitutions, improvements, etc. made without departing from the spirit and principles of the disclosure shall fall within the protection scope of the present disclosure.

What is claimed is:

1. A circuit for preventing screen flickering, which is applicable to a drive circuit for a display panel, the drive circuit comprising a gate drive circuit, wherein the circuit for preventing screen flickering comprises:

a control sub-circuit configured to control the gate drive circuit to output a gate cut-off level during a power-on period of the display panel;

wherein the gate drive circuit comprises a first noise reduction module and a second noise reduction module, the drive circuit further comprises a level shift circuit, and the level shift circuit is configured to provide a first noise reduction voltage signal for the first noise reduction module and provide a second noise reduction voltage signal for the second noise reduction module;

the circuit for preventing screen flickering further comprises a determination sub-circuit configured to determine whether it is in the power-on period based on the first noise reduction voltage signal and the second noise reduction voltage signal;

the determination sub-circuit is configured to determine whether voltages of the first noise reduction voltage signal and the second noise reduction voltage signal are equal, wherein it is in the power-on period if the voltages of the first noise reduction voltage signal and the second noise reduction voltage signal are equal; and the control sub-circuit is configured to control the gate drive circuit to output the gate cut-off level when the voltages of the first noise reduction voltage signal and the second noise reduction voltage signal are equal.

2. The circuit for preventing screen flickering according to claim 1, wherein the gate drive circuit comprises a noise reduction module which is configured to pull an output level of the gate drive circuit to the gate cut-off level when a noise reduction voltage signal received by the noise reduction module is a turn-on level; and wherein the control sub-circuit is configured to control the noise reduction voltage signal outputted to the noise reduction module to be the turn-on level during the power-on period.

3. The circuit for preventing screen flickering according to claim 2, wherein the control sub-circuit is configured to output an external input voltage signal of the drive circuit as the noise reduction voltage signal to the noise reduction module during the power-on period.

4. The circuit for preventing screen flickering according to claim 1, wherein the determination sub-circuit comprises:

a first comparator and a second comparator, wherein each of the first comparator and the second comparator comprises a non-inverting input terminal, an inverting input terminal and an output terminal; both the non-inverting input terminal of the first comparator and the inverting input terminal of the second comparator are electrically connected to a first noise reduction voltage signal output terminal of the level shift circuit; both the inverting input terminal of the first comparator and the non-inverting input terminal of the second comparator are electrically connected to a second noise reduction voltage signal output terminal of the level shift circuit; and an OR gate, wherein two input terminals of the OR gate are respectively electrically connected to the output terminal of the first comparator and the output terminal of the second comparator, and an output terminal of the OR gate is electrically connected to a control terminal of the control sub-circuit;

wherein the first noise reduction voltage signal output terminal is configured to output the first noise reduction voltage signal, and the second noise reduction voltage signal output terminal is configured to output the second noise reduction voltage signal.

5. The circuit for preventing screen flickering according to claim 1, wherein the control sub-circuit comprises:

a first selector, wherein two input terminals of the first selector are respectively electrically connected to the first noise reduction voltage signal output terminal of the level shift circuit and an external input voltage signal input terminal of a power management integrated circuit of the display panel; a control terminal of the first selector is electrically connected to an output terminal of the determination sub-circuit; the first selector is configured to output one of the first noise reduction voltage signal and an external input voltage signal through an output terminal of the first selector under control of an output signal of the determination sub-circuit; and a second selector, wherein two input terminals of the second selector are respectively electrically connected to the second noise reduction voltage signal output terminal of the level shift circuit and the external input voltage signal input terminal of the power management integrated circuit; a control terminal of the second selector is electrically connected to the output terminal of the determination sub-circuit; the second selector is configured to output one of the second noise reduction voltage signal and the external input voltage signal through an output terminal of the second selector under control of the output signal of the determination sub-circuit;

wherein the external input voltage signal input terminal is configured to receive the external input voltage signal provided to the drive circuit for the display panel.

6. A drive circuit for a display panel, comprising a gate drive circuit and a circuit for preventing screen flickering, wherein the circuit for preventing screen flickering comprises:

a control sub-circuit configured to control the gate drive circuit to output a gate cut-off level during a power-on period of the display panel;

wherein the gate drive circuit comprises a first noise reduction module and a second noise reduction module, the drive circuit further comprises a level shift circuit, and the level shift circuit is configured to provide a first noise reduction voltage signal for the first noise reduction module and provide a second noise reduction voltage signal for the second noise reduction module;

the circuit for preventing screen flickering further comprises a determination sub-circuit configured to determine whether it is in the power-on period based on the first noise reduction voltage signal and the second noise reduction voltage signal;

the determination sub-circuit is configured to determine whether voltages of the first noise reduction voltage signal and the second noise reduction voltage signal are equal, wherein it is in the power-on period if the voltages of the first noise reduction voltage signal and the second noise reduction voltage signal are equal; and the control sub-circuit is configured to control the gate drive circuit to output the gate cut-off level when the voltages of the first noise reduction voltage signal and the second noise reduction voltage signal are equal.

7. The drive circuit according to claim 6, wherein the gate drive circuit comprises a noise reduction module which is configured to pull an output level of the gate drive circuit to the gate cut-off level when a noise reduction voltage signal received by the noise reduction module is a turn-on level; and wherein the control sub-circuit is configured to control the noise reduction voltage signal outputted to the noise reduction module to be the turn-on level during the power-on period.

8. The drive circuit according to claim 7, wherein the control sub-circuit is configured to output an external input voltage signal of the drive circuit as the noise reduction voltage signal to the noise reduction module during the power-on period.

9. The drive circuit according to claim 6, wherein the determination sub-circuit comprises:

a first comparator and a second comparator, wherein each of the first comparator and the second comparator comprises a non-inverting input terminal, an inverting input terminal and an output terminal; both the non-inverting input terminal of the first comparator and the inverting input terminal of the second comparator are electrically connected to a first noise reduction voltage signal output terminal of the level shift circuit; both the inverting input terminal of the first comparator and the non-inverting input terminal of the second comparator are electrically connected to a second noise reduction voltage signal output terminal of the level shift circuit; and an OR gate, wherein two input terminals of the OR gate are respectively electrically connected to the output terminal of the first comparator and the output terminal of the second comparator, and an output terminal of the OR gate is electrically connected to a control terminal of the control sub-circuit;

wherein the first noise reduction voltage signal output terminal is configured to output the first noise reduction voltage signal, and the second noise reduction voltage signal output terminal is configured to output the second noise reduction voltage signal.

10. The drive circuit according to claim 6, wherein the control sub-circuit comprises:

a first selector, wherein two input terminals of the first selector are respectively electrically connected to the first noise reduction voltage signal output terminal of the level shift circuit and an external input voltage signal input terminal of a power management integrated circuit of the display panel; a control terminal of the first selector is electrically connected to an output terminal of the determination sub-circuit; the first selector is configured to output one of the first noise reduction voltage signal and an external input voltage signal through an output terminal of the first selector under control of an output signal of the determination sub-circuit; and a second selector, wherein two input terminals of the second selector are respectively electrically connected to the second noise reduction voltage signal output terminal of the level shift circuit and the external input voltage signal input terminal of the power management integrated circuit; a control terminal of the second selector is electrically connected to the output terminal of the determination sub-circuit; the second selector is configured to output one of the second noise reduction voltage signal and the external input voltage signal through an output terminal of the second selector under control of the output signal of the determination sub-circuit;

wherein the external input voltage signal input terminal is configured to receive the external input voltage signal provided to the drive circuit for the display panel.

11. A display apparatus, comprising the drive circuit according to claim 6.

12. A method for preventing screen flickering, which is applicable to a drive circuit for a display panel, the drive circuit comprising a gate drive circuit, wherein the method comprises:

controlling the gate drive circuit to output a gate cut-off level during a power-on period of the display panel;

wherein the gate drive circuit comprises a first noise reduction module and a second noise reduction module, the drive circuit further comprises a level shift circuit, and the level shift circuit is configured to provide a first noise reduction voltage signal for the first noise reduction module and provide a second noise reduction voltage signal for the second noise reduction module;

the method further comprises: determining whether it is in the power-on period based on the first noise reduction voltage signal and the second noise reduction voltage signal;

said determining whether it is in the power-on period based on the first noise reduction voltage signal and the second noise reduction voltage signal comprises: determining whether voltages of the first noise reduction voltage signal and the second noise reduction voltage signal are equal, wherein it is in the power-on period if the voltages of the first noise reduction voltage signal and the second noise reduction voltage signal are equal; and said controlling the gate drive circuit to output the gate cut-off level during the power-on period of the display panel comprises: controlling the gate drive circuit to output the gate cut-off level when the voltages of the first noise reduction voltage signal and the second noise reduction voltage signal are equal.

13. The method according to claim 12, wherein the gate drive circuit comprises a noise reduction module which is configured to pull an output level of the gate drive circuit to the gate cut-off level when a noise reduction voltage signal received by the noise reduction module is a turn-on level; and wherein said controlling the gate drive circuit to output the gate cut-off level during the power-on period of the display panel comprises:

controlling the noise reduction voltage signal outputted to the noise reduction module to be the turn-on level during the power-on period.

14. The method according to claim 13, wherein said controlling the noise reduction voltage signal outputted to the noise reduction module to be the turn-on level during the power-on period comprises:

outputting an external input voltage signal of the drive circuit as the noise reduction voltage signal to the noise reduction module during the power-on period.

15. The display apparatus according to claim 11, wherein the gate drive circuit comprises a noise reduction module which is configured to pull an output level of the gate drive circuit to the gate cut-off level when a noise reduction voltage signal received by the noise reduction module is a turn-on level; and wherein the control sub-circuit is configured to control the noise reduction voltage signal outputted to the noise reduction module to be the turn-on level during the power-on period.

16. The display apparatus according to claim 15, wherein the control sub-circuit is configured to output an external input voltage signal of the drive circuit as the noise reduction voltage signal to the noise reduction module during the power-on period.

17. The display apparatus according to claim 11, wherein the determination sub-circuit comprises:

a first comparator and a second comparator, wherein each of the first comparator and the second comparator comprises a non-inverting input terminal, an inverting input terminal and an output terminal; both the non-inverting input terminal of the first comparator and the inverting input terminal of the second comparator are electrically connected to a first noise reduction voltage signal output terminal of the level shift circuit; both the inverting input terminal of the first comparator and the non-inverting input terminal of the second comparator are electrically connected to a second noise reduction voltage signal output terminal of the level shift circuit; and an OR gate, wherein two input terminals of the OR gate are respectively electrically connected to the output terminal of the first comparator and the output terminal of the second comparator, and an output terminal of the OR gate is electrically connected to a control terminal of the control sub-circuit;

wherein the first noise reduction voltage signal output terminal is configured to output the first noise reduction voltage signal, and the second noise reduction voltage signal output terminal is configured to output the second noise reduction voltage signal.

18. The display apparatus according to claim 11, wherein the control sub-circuit comprises:

a first selector, wherein two input terminals of the first selector are respectively electrically connected to the first noise reduction voltage signal output terminal of the level shift circuit and an external input voltage signal input terminal of a power management integrated circuit of the display panel; a control terminal of the first selector is electrically connected to an output terminal of the determination sub-circuit; the first selector is configured to output one of the first noise reduction voltage signal and an external input voltage signal through an output terminal of the first selector under control of an output signal of the determination sub-circuit; and a second selector, wherein two input terminals of the second selector are respectively electrically connected to the second noise reduction voltage signal output terminal of the level shift circuit and the external input voltage signal input terminal of the power management integrated circuit; a control terminal of the second selector is electrically connected to the output terminal of the determination sub-circuit; the second selector is configured to output one of the second noise reduction voltage signal and the external input voltage signal through an output terminal of the second selector under control of the output signal of the determination sub-circuit;

wherein the external input voltage signal input terminal is configured to receive the external input voltage signal provided to the drive circuit for the display panel.

* * * * *